US005714692A

United States Patent [19]

Rohde

[11] Patent Number: 5,714,692

[45] Date of Patent: Feb. 3, 1998

[54] METHOD OF COMPENSATING FORCES IN ROLL STANDS RESULTING FROM HORIZONTAL MOVEMENTS OF THE ROLLS

[75] Inventor: Wolfgang Rohde, Dormagen, Germany

[73] Assignee: SMS Schloemann-Siemag Aktiengesellschaft, Düsseldorf, Germany

[21] Appl. No.: 699,100

[22] Filed: Aug. 16, 1996

[30] Foreign Application Priority Data

Aug. 18, 1995 [DE] Germany ..... 195 30 424.1

[51] Int. Cl.[6] ..... G01L 5/00

[52] U.S. Cl. ..... 73/862.55; 73/159

[58] Field of Search ..... 73/159, 862.55, 73/862.622, 862.454; 72/11, 19–21

[56] References Cited

U.S. PATENT DOCUMENTS

| | | | |
|---|---|---|---|
| 2,166,153 | 7/1939 | Huck | 73/862.55 |
| 3,383,591 | 5/1968 | Roberts | 73/862.55 X |
| 3,918,302 | 11/1975 | Skelton et al. | 73/862.55 X |
| 4,033,183 | 7/1977 | List et al. | 73/862.55 X |
| 4,974,442 | 12/1990 | Ives et al. | 73/862.55 X |
| 4,993,270 | 2/1991 | Petitet | 73/862.55 |
| 5,090,224 | 2/1992 | Svagr et al. | 73/862.55 X |
| 5,181,408 | 1/1993 | Yeh et al. | 73/862.55 X |
| 5,187,960 | 2/1993 | Taguchi | 73/862.55 X |
| 5,201,272 | 4/1993 | Simon | 73/862.55 X |

FOREIGN PATENT DOCUMENTS

| | | |
|---|---|---|
| 0080024 | 6/1980 | Japan . |
| 0118631 | 9/1981 | Japan . |

*Primary Examiner*—Elizabeth L. Dougherty
*Attorney, Agent, or Firm*—Friedrich Kueffner

[57] ABSTRACT

A method of compensating forces of force components resulting from horizontal movements of the rolls in roll stands for hot-rolling and cold-rolling of flat products, wherein the roll stands are equipped with work rolls and with one or more back-up rolls, with hydraulic adjusting units and with force measuring devices on the opposite side of the roll gap and with hydraulic devices for the horizontal displacement of the work rolls. The pressures in the two adjusting cylinders are utilized for determining the rolling forces on one side of the roll gap and the forces indicated by the force measuring devices are utilized for determining the rolling forces on the opposite side of the roll gap, and all axial forces in the stand are computed during the rolling operation by including the axial forces of the work rolls which can be determined through the pressures in the displacement cylinders of the work rolls.

9 Claims, 5 Drawing Sheets

FIG. 3

ELimination of $T_W$ by

Addition of GL (3) and GL (6), and with GL (4)

$$2 F_W X + (F_2 - F_1 + F_4 - F_3) \cdot 1/2a - (T_2 + T_3) \cdot (r_A + r_S) = 0$$

$$X = \frac{[(F_1 - F_2) + (F_3 - F_4)] \cdot 1/2a + (T_2 + T_3) \cdot (r_A + r_S)}{2 \cdot (F_3 + F_4)} \quad \text{GL (7)}$$

ELimination of X by

Subtraction of GL (6) from GL (3)

$$(F_2 - F_1 - F_4 + F_3) \cdot 1/2a + (T_3 - T_2)(r_A + r_S) + 2 \cdot T_W \cdot (2 \cdot r_A + r_S) = 0$$

$$T_W = \frac{[(F_1 - F_2) - (F_3 - F_4)] \cdot 1/2a + (T_2 - T_3)(r_A + r_S)}{2 : (r_A + r_S)} \quad \text{GL (8)}$$

From GL (2) and GL (8)

$$T_1 = T_W - T_2$$

$$T_1 = \frac{[(F_1 - F_2) - (F_3 - F_4)] \cdot 1/2a - T_2(3 \cdot r_A + r_S) - T_3 \cdot (r_A + r_S)}{2 \cdot (2 r_A + r_S)} \quad \text{GL (9)}$$

From GL (5) and GL (8)

$$T_4 = - T_W - T_3$$

$$T_4 = \frac{[(F_3 - F_4) - (F_1 - F_2)] \cdot 1/2a - T_3(3 r_A + r_S) - T_2(r_A + r_S)}{2 \cdot (2 r_A + r_S)} \quad \text{GL (10)}$$

FIG. 4

1. Reaction Forces from the Axial Forces $R_{I,K}$ $\quad$ $i$ = Measurement Location $\quad (F_1, F_2, F_3, F_4)$ $\quad\quad\quad\quad$ $K$ = Roll $\quad (T_1, T_2, T_3, T_4)$ $$R_{1,1} = + T_1 \cdot \frac{2 \cdot r_A + r_S}{a} \qquad R_{2,1} = - T_1 \cdot \frac{2 \cdot r_A + r_S}{a}$$

$$R_{1,2} = + T_2 \cdot \frac{r_A}{a} \qquad R_{2,2} = - T_2 \cdot \frac{r_A}{a}$$

$$R_{3,3} = + T_3 \cdot \frac{r_A}{a} \qquad R_{4,3} = - T_3 \cdot \frac{r_A}{a}$$

$$R_{3,4} = + T_4 \cdot \frac{2 \cdot r_A + r_S}{a} \qquad R_{4,4} = - T_4 \cdot \frac{2 \cdot r_A + r_S}{a}$$

Sum of the Individual Forces $$R_1 = + \frac{T_1 \cdot (2 \cdot r_A + r_S) + T_2 \cdot r_A}{a} \qquad R_2 = - \frac{T_1 \cdot (2 \cdot r_A + r_S) + T_2 \cdot r_A}{a}$$

$$R_3 = + \frac{T_4 \cdot (2 \cdot r_A + r_S) + T_3 \cdot r_A}{a} \qquad R_4 = - \frac{T_4 \cdot (2 \cdot r_A + r_S) + T_3 \cdot r_A}{a}$$

2. Reaction Forces from Eccentricity $$R_{1,x} = + F_W \cdot x/a \qquad R_{2,x} = - F_W \cdot x/a$$

$$R_{3,x} = + F_W \cdot x/a \qquad R_{4,x} = - F_W \cdot x/a$$

FIG. 5

Example

| | | |
|---|---|---|
| $r_A$ = 0,6 m | $r_S$ = 0,7 m | a = 2,8 m |
| $F_1$ = 11,929 MN | $F_2$ = 8,071 MN | $F_W$ = 20 MN |
| $F_3$ = 11,125 MN | $F_4$ = 8,875 MN | $F_W$ = 20 MN |
| $T_2$ = - 1,0 MN | $T_3$ = 0,5 MN | |

| | |
|---|---|
| From GL (7) | X = 0,2 m |
| From GL (8) | $T_W$ = 0,200 MN |
| From GL (9) | $T_1$ = 1,200 MN |
| From GL (10) | $T_4$ = - 0,700 MN |

TEST:

GL (1) -> 0
GL (2) -> 0
GL (3) -> 0
GL (4) -> 0
GL (5) -> 0
GL (6) -> 0

Reaction to Axial Forces $R_1$ = + 0,500 MN $R_2$ = - 0,500 MN
$R_3$ = - 0,304 MN $R_4$ = + 0,304 MN Reaction to Eccentricity $R_{1,X}$ = + 1,429 MN $R_{2,X}$ = - 1,429 MN
$R_{3,X}$ = + 1,429 MN $R_{4,X}$ = - 1,429 MN

METHOD OF COMPENSATING FORCES IN ROLL STANDS RESULTING FROM HORIZONTAL MOVEMENTS OF THE ROLLS

BACKGROUND OF THE INVENTION

1. Field of the Invention

The present invention relates to a method of compensating forces of force components resulting from horizontal movements of the rolls in roll stands for hot-rolling and cold-rolling of flat products, wherein the roll stands are equipped with work rolls and with one or more back-up rolls, with hydraulic adjusting units and with force measuring devices on the opposite side of the roll gap and with hydraulic devices for the horizontal displacement of the work rolls.

2. Description of the Related Art

When rolling flat products in hot-rolling plants and cold-rolling plants, there is the problem that all participating rolls are axially moved in the stand in different directions during the rolling process and produce axial forces by pressing against the respectively provided locking means. Together with the corresponding reaction forces, these axial forces produce free pairs of forces at a distance from the roll center to the contact with the neighboring roll. Each of these pairs of forces results in reaction forces in the roll bearings and, thus, in the two housing posts of the stand.

FIG. 1 of the drawing illustrates the basic problem, for example, in connection with the upper back-up roll 1 of a four-high stand. The horizontally acting forces T are linearly aligned vectors, i.e., they can be displaced along their lines of influence. Consequently, it is of no significance on what side of the stand the roll is locked. Such pairs of forces are basically always produced by the axial force in the area of contact with the neighboring roll. The individual forces are superimposed and manifest themselves in different axial forces at all participating rolls and result in reaction forces in the roll housings which are difficult to determine.

The reaction forces in the roll housings show extremely disadvantageous effects especially in reversing stands. When the direction of rotation is reversed, the srew-type direction of rotation of all participating rolls also changes. The rolls travel toward the respectively opposite sides which results in a reversal of the axial forces. The reaction forces in the roll housings change accordingly, so that the force measuring devices arranged in the housings indicate changes which are in no relation to the actual rolling process. This results in erroneous reactions of all control circuits which depend from the forces measured in the roll housing, such as, the planeness control, the automatic calibration for the parallel adjustment of the roll gap, the roll alignment control for compensating the effects of an eccentric position of the rolled product and other control circuits depending on the type of roll stand and rolled product.

It is already known in the art to determine by computation or by means of measuring devices the vertical forces generated in the stand, such as, the forces from the own weights, from the roll balancing means and the roll bending means, and to take these vertical forces into consideration when measuring the forces in the two roll housings. However, such compensations have not been carried out for reaction forces from the above-described axial forces of the rolls.

SUMMARY OF THE INVENTION

Therefore, it is the primary object of the present invention to determine with sufficient certainty the reaction forces in the roll housings without having to establish additional measuring points in the roll stand.

In accordance with the present invention, in a method of compensating the forces or force components resulting from the horizontal movements of the rolls in roll stands of the above-described type, the pressures in the two adjusting cylinders are utilized for determining the rolling forces on one side of the roll gap and the forces indicated by the force measuring devices are utilized for determining the rolling forces on the opposite side of the roll gap, and all axial forces in the stand are computed during the rolling operation by including the axial forces of the work rolls which can be determined through the pressures in the displacement cylinders of the work rolls.

The method according to the present invention makes it possible to continuously determine all vagrant forces occurring in a roll stand from horizontal movements of the rolls and to compensate the resulting force components in the measured rolling forces.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

BRIEF DESCRIPTION OF THE DRAWING

In the drawing:

FIG. 3 is a compilation of the equations representing a force equilibrium in the stand;

FIG. 4 is a compilation of equations for the reaction forces from the axial forces and for the reaction forces from the eccentricity of the rolling force; and FIG. 5 is an example of the computation of the axial forces of the rolls and the reaction forces.

DESCRIPTION OF THE PREFERRED EMBODIMENT

Figure 1:
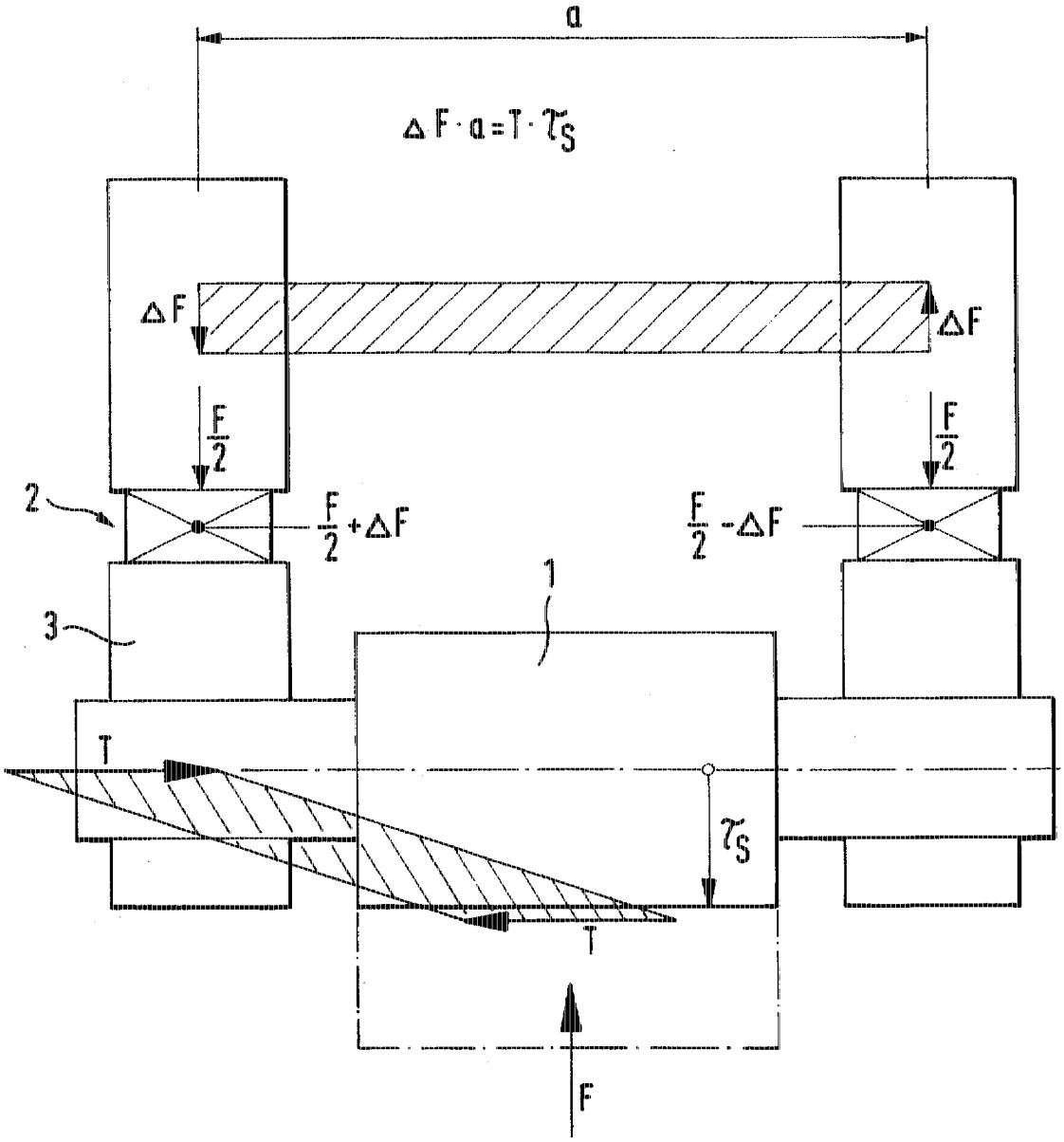
FIG. 1 is a schematic illustration showing the forces acting on the upper back-up roll of a four-high stand.

Modern roll stands for cold-rolled and hot-rolled flat products are equipped today almost exclusively with hydraulic adjustment means 2 as the adjusting members for the thickness control. The adjusting cylinders of the hydraulic adjustment means are located above the upper back-up roll chocks 3 or below the lower back-up chocks 4.

In a preferred embodiment, force measuring devices 5 are additionally provided in the two roll housings on the opposite side of the stand seen from the roll gap, wherein the force measuring devices 5 serve the purpose of continuously measuring the forces occurring during the rolling process in the two roll housings.

The two hydraulic cylinders of the hydraulic adjusting means provide via the hydraulic pressure in a preferred manner additional measurement values for the forces in the two roll housings, so that measuring values for the forces in the two roll housings above the upper back-up roll chocks and below the lower back-up roll chocks are available without additional requirements.

Another feature of modern roll stands for hot-rolling and cold-rolling of flat products are displaceable work rolls 6, for example, for influencing the roll gap profile or for rendering the roll wear uniform. In a preferred embodiment, the displacement of the work rolls 6 is effected by means of hydraulic cylinders 7. Independently of whether the two work rolls are displaced during a phase of operation or are in a certain position, pressures are generated in the hydraulic cylinders 7 in dependence on the axial forces emanating from the work rolls 6. Consequently, the axial forces of the work rolls can be determined in a preferred manner without additional requirements for measuring the pressure in the displacement cylinders. As a result, altogether six measurement values are available for vertical and horizontal forces in the roll stand.

Figure 2:
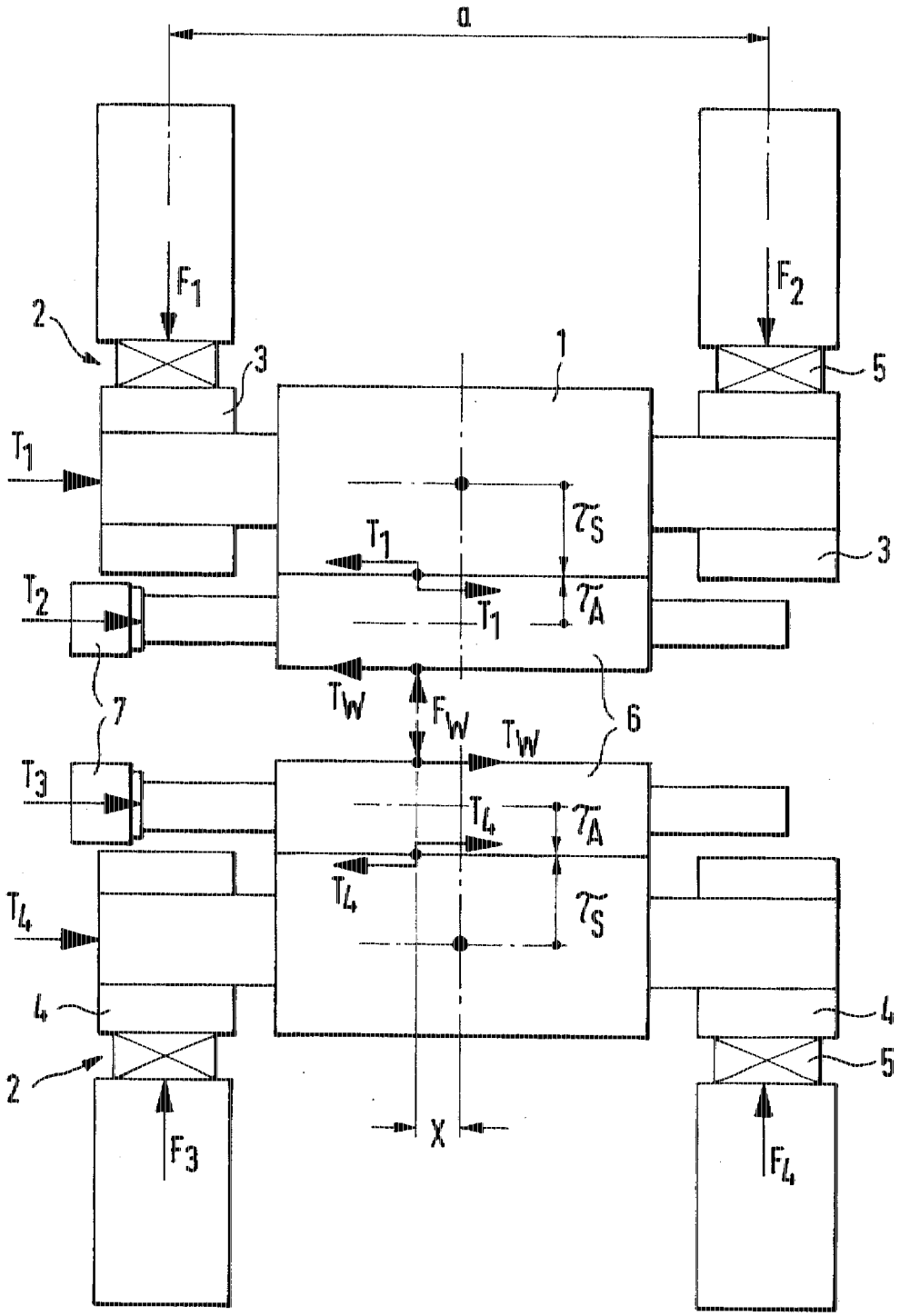
FIG. 2 is a schematic illustration showing the forces acting in a roll stand.

FIG. 2 shows an analysis of the forces in a roll stand. Shown in FIG. 2 are only the forces F from the rolling process and the axial forces T of the rolls. The balancing forces, the bending forces and the forces resulting from weight are not shown because the compensation of these forces is known in the art.

The statement of the equilibrium conditions for horizontal forces T, vertical forces F and moments M at the upper and lower sets of rolls results in altogether six equations. These six equations GL shown below represent the force equilibrium as follows:

Top of Stand:
Vertical Forces F:

$$F_w-F_1-F_2=0 \qquad \text{GL(1)}$$

Horizontal Forces T:

$$T_w-T_1-T_2=0 \qquad \text{GL(2)}$$

Moments M:

$$F_w\cdot X-F_1\cdot a/2+F_2\cdot a/2-T_2(r_A+r_s)+T_w(2r_A+r_s)=0 \qquad \text{GL(3)}$$

Bottom of Stand:
Vertical Forces F:

$$F_w-F_3-F_4=0 \qquad \text{GL(4)}$$

Horizontal Forces T:

$$T_w+T_3+T_4=0 \qquad \text{GL(5)}$$

Moments M:

$$F_w\cdot X-F_3\cdot a/2+F_4\cdot a/2-T_3(r_A+r_s)-T_w(2r_A+r_s)=0 \qquad \text{GL(6)}$$

From these six equations, it is possible via mathematical conversions to determine the equations for the forces $T_1$ and $T_4$ emanating from the back-up rolls and the tangential force $T_w$ occurring in the roll gap. Thus, all the horizontally acting forces occurring in the stand are known.

FIG. 3 is a compilation of the set of equations.

Of particular interest for the position of the resulting rolling force in the roll gap is the derivation of a deviation X from the center, as seen in FIG. 2. This value can also be continuously determined from the six measurement values during the rolling operation. The equation for the deviation X from center is shown in FIG. 3. The value X can be utilized for the automatic calibration, i.e., for automatically placing the two work rolls in parallel positions; this is done after a roll change by pretensioning the stand without rolled product with rotating rolls and computing the eccentricity X from the six measurement values. By carrying out a pivoting movement by means of the hydraulic adjusting means, the value X is controlled so as to become zero, so that the upper and lower rolls are exactly in a parallel position.

The deviation X from center can also be used for monitoring the rolling process, particularly in reversing stands in which the strip or sheet can travel from the center of the stand. The deviation X from center can be utilized for reporting such events and for carrying out an appropriate correction.

Of course, the automatic calibration and monitoring of the rolling process can also be effected in such a way that, instead of the introduction of the deviation from center, a correction or compensation of the measured forces $F_1$ through $F_4$ is effected with the aid of the computable reaction forces from the axial forces. The equations for the sum of the reaction forces from all participating rolls required for this purpose are indicated with $R_1$ through $R_4$ in FIG. 4. After such a compensation, the measurement values $F_1$ through $F_4$ can be utilized in the known manner by forming the difference $F_1-F_2$ or $F_3-F_4$ for the calibration of the rolls and for monitoring the rolling process.

The equations for determining the axial forces of the rolls and the deviation from center have the particular advantage that the measurement values for the axial forces in the upper or lower areas of the stand enter the evaluation always as differential values. This produces the result that the friction forces contained in the measurement values, particularly in the measurement values from the adjusting cylinders, do not enter into the evaluation as long as the friction forces are equal on both sides of the stand. This is true for a determination of the measurement values during opening movements on both sides or closing movements on both sides of the hydraulic adjustment means. If a pivoting movement is carried out, the friction forces of both stand sides would be added. Consequently, the operation is to be carried out in such a way that the determination of the measurement values is suppressed during a pivoting movement.

It has also been found advantageous to utilize the measured and computed axial forces $T_1$ through $T_4$ and $T_w$ for monitoring the state of maintenance and the exactly ground contour of the rolls. Substantial wear of the rolls and errors in the way the rolls are ground increase the relative inclination of the rolls and lead to increased axial forces. Consequently, a display of these forces is an excellent way to continuously monitor the rolling mill.

FIG. 4 of the drawing shows the set of equations for the reaction forces from the axial forces and for the reaction forces from the deviation from center of the roll force.

FIG. 5 shows a computation example with assumed roll stand data and rolling data and the axial roll forces and reaction forces computed by means of the above-described equations.

While specific embodiments of the invention have been shown and described in detail to illustrate the inventive principles, it will be understood that the invention may be embodied otherwise without departing from such principles.

I claim:

1. A method of compensating forces or force components resulting from horizontal movements of rolls in a roll stand for hot-rolling and cold-rolling of flat products, the roll stand including work rolls defining a roll gap having first and second sides, and at least one back-up roll, hydraulic adjustment means for the rolls mounted on the first side of the roll gap and force measuring devices mounted on the second side of the roll gap, and hydraulic displacement means for horizontally displacing the work rolls, the method comprising measuring pressure supplied by the hydraulic adjustment means for determining rolling forces on the first side of the roll gap and measuring forces displayed by the force measuring devices for determining rolling forces on the second side of the roll gap, and computing all axial forces during rolling operation by including axial forces of the work rolls measured through pressures applied by the displacement means on the work rolls.

2. The method according to claim 1, wherein the force measuring devices are mounted in roll housings, comprising computing from the axial forces of the work rolls and the at least one back-up roll correction values for rolling force indicators of the force measuring devices in the two roll housings, so that reaction forces of the axial forces are compensated.

3. The method according to claim 1, comprising computing an actual eccentricity of the rolling force acting on the work rolls from the two rolling forces applied by the hydraulic adjustment means, from the two rolling forces measured by the force measuring devices, and from the two axial forces of the work roll applied by the hydraulic displacement means.

4. The method according to claim 3, comprising controlling the determined eccentricity of the rolling force during calibration of the roll stand for a parallel alignment of the rolls until the eccentricity reaches zero.

5. The method according to claim 2, comprising computing the reaction forces in the two roll housings resulting from the rolling forces of the work rolls and the at least one back-up roll, computing expansion of the rolls resulting from the reaction forces, and compensating the expansions by adjusting the horizontal displacement means.

6. The method according to claim 4, comprising, when carrying out an automatic calibration, utilizing the measurement values for the rolling forces applied by the hydraulic adjustment means and for the rolling forces measured by the force measuring devices and the axial forces of the work rolls applied by the hydraulic displacement means only during an adjustment movement carried out in the same direction by the hydraulic adjustment means on both sides of the stand.

7. The method according to claim 1, comprising, for monitoring a state of wear of the rolls, continuously displaying the measured axial forces of the back-up rolls, the forces applied by the displacement means and the computed axial forces of the work rolls.

8. The method according to claim 2, comprising, after compensating the rolling force indications with the reaction forces computed from the actual forces of the rolls in the two roll housings, controlling a remaining difference of the rolling force indications in the upper and lower portions of the stand until the difference reaches zero in order to effect a parallel alignment of the rolls.

9. The method according to claim 2, comprising, after compensating the rolling force indications with the reaction forces computed from the actual forces of the rolls in the two roll housings, utilizing a remaining difference of the rolling force indications in the upper and lower portions of the stand for continuously monitoring the rolling process.

* * * * *